US007780908B2

(12) United States Patent
Hsieh et al.

(10) Patent No.: US 7,780,908 B2
(45) Date of Patent: Aug. 24, 2010

(54) LOW NICKEL CONTAINING CHROMIUM-NICKEL-MANGANESE-COPPER AUSTENITIC STAINLESS STEEL

(75) Inventors: Meng-Hsin Hsieh, Tainan (TW); Yi-Cheng Wu, Kaohsiung (TW); Pei-Te Huang, Kaohsiung Hsien (TW); Hao-Shang Liu, Kaohsiung (TW)

(73) Assignee: Yieh United Steel Corp., Kaohsiung-Hsien (TW)

( * ) Notice: Subject to any disclaimer, the term of this patent is extended or adjusted under 35 U.S.C. 154(b) by 112 days.

(21) Appl. No.: 11/866,869

(22) Filed: Oct. 3, 2007

(65) Prior Publication Data

US 2008/0075623 A1 Mar. 27, 2008

Related U.S. Application Data

(63) Continuation-in-part of application No. 10/993,674, filed on Nov. 19, 2004, now abandoned, which is a continuation-in-part of application No. 10/353,167, filed on Jan. 28, 2003, now abandoned.

(30) Foreign Application Priority Data

Oct. 23, 2002 (TW) ..... 91124567 A

(51) Int. Cl.
*C22C 38/58* (2006.01)

(52) U.S. Cl. ..... 420/58; 420/73; 420/74; 420/76

(58) Field of Classification Search ..... 420/58, 420/57, 60, 61, 72–76; 148/327, 605–611
See application file for complete search history.

(56) References Cited

U.S. PATENT DOCUMENTS

| | | | |
|---|---|---|---|
| 3,615,365 | A | 10/1971 | McCunn |
| 5,286,310 | A | 2/1994 | Carinci et al. |
| 6,056,917 | A | 5/2000 | Chesseret et al. |

OTHER PUBLICATIONS

"Table 1.1 Essential and incidental elements in steel and cast iron", Introduction to Steels and Cast Iron, 1982, ASM.*

* cited by examiner

*Primary Examiner*—Deborah Yee
(74) *Attorney, Agent, or Firm*—Fox Rothschild, LLP; Robert J. Sacco

(57) ABSTRACT

An austenitic stainless steel includes (a) 0.03 wt % to 0.12 wt % of C, (b) 0.2 wt % to 1.0 wt % of Si, (c) 8.55 wt % to 10.12 wt % of Mn, (d) 14.0 wt % to 16.0 wt % of Cr, (e) 4.05 wt % to 4.31 wt % of Ni, (f) 0.04 wt % to 0.07 wt % of N, (g) 1.0 wt % to 3.5 wt % of Cu, (h) trace amount of Mo, and the balance being Fe and incidental impurities. The austenitic stainless steel has a δ-ferrite content less than 8.5 and equal to 6.77 [(d)+(h)+1.5(b)]−4.85[(e)+30(a)+30(f)+0.5(c)+0.3(g)]−52.75.

3 Claims, 1 Drawing Sheet

LOW NICKEL CONTAINING CHROMIUM-NICKEL-MANGANESE-COPPER AUSTENITIC STAINLESS STEEL

CROSS-REFERENCE TO RELATED APPLICATIONS

This application is a continuation-in-part (CIP) of U.S. patent application Ser. No. 10/993,674, filed Nov. 19, 2004, now abandoned which is a continuation-in-part (CIP) of U.S. patent application Ser. No. 10/353,167, filed Jan. 28, 2003, now abandoned, the entire disclosures of which are incorporated herein by reference.

BACKGROUND OF THE INVENTION

1. Field of the Invention

This invention relates to an austenitic stainless steel, more particularly to a low nickel containing chromium-nickel-manganese-copper austenitic stainless steel.

2. Description of the Related Art

U.S. Pat. No. 5,286,310 discloses a low nickel containing chromium-nickel-manganese-copper austenitic stainless steel that has a reduced nickel content and acceptable metallographic structure, mechanical strength, corrosion resistance and workability. The aforesaid austenitic stainless steel contains at least 16.5% by weight of chromium so as to provide acceptable corrosion resistance. However, the chromium content should not exceed 17.5% by weight so as to prevent undesired formation of delta ferrite (δ-ferrite) during hot working and impairment to hot workability. The aforesaid austenitic stainless steel further contains at least 2.5% by weight of nickel so as to improve cold workability and so as to inhibit transformation of austenite into martensite. However, nickel content should not exceed 5% by weight due to the relatively high price thereof.

Although the aforesaid austenitic stainless steel is capable of providing acceptable corrosion resistance and cold or hot workability, the chromium content thereof is still high (previous investigation has shown that at least 17% by weight of chromium is necessary to provide minimum levels of corrosion resistance), which can impair stability of the austenitic stainless steel and which can cause cracking during hot rolling.

The disclosure of U.S. Pat. No. 5,286,310 is incorporated herein by reference.

U.S. Pat. No. 3,615,365 discloses an austenitic stainless steel consisting essentially of up to 0.12% carbon, from about 5 to 8.5% manganese, up to about 2% silicon, from about 15 to about 17.5% chromium, from about 3.5 to about 6.5% nickel, from about 0.75 to about 2.5% copper, up to about 0.05% nitrogen, and the remainder essentially iron with incidental impurities.

SUMMARY OF THE INVENTION

Therefore, it is an object of the present invention to provide a low nickel containing chromium-nickel-manganese-copper austenitic stainless steel that is capable of overcoming the aforesaid drawbacks of the prior art.

According to this invention, there is provided an austenitic stainless steel that comprises: (a) 0.03 wt % to 0.12 wt % of C; (b) 0.2 wt % to 1.0 wt % of Si; (c) 8.55 wt % to 10.12 wt % of Mn; (d) 14.0 wt % to 16.0 wt % of Cr; (e) 4.05 wt % to 4.31 wt % of Ni; (f) 0.04 wt % to 0.07 wt % of N; (g) 1.0 wt % to 3.5 wt % of Cu; (h) trace amount of Mo; and the balance being Fe and incidental impurities. The austenitic stainless steel has a δ-ferrite content that is less than 8.5 and that satisfies the following formula $$\delta\text{-ferrite}=6.77[(d)+(h)+1.5(b)]-4.85[(e)+30(a)+30(f)+0.5(c)+0.3(g)]-52.75.$$

BRIEF DESCRIPTION OF THE DRAWING

In the drawing which illustrates an embodiment of the invention.

DETAILED DESCRIPTION OF THE PREFERRED EMBODIMENT

Figure 1:
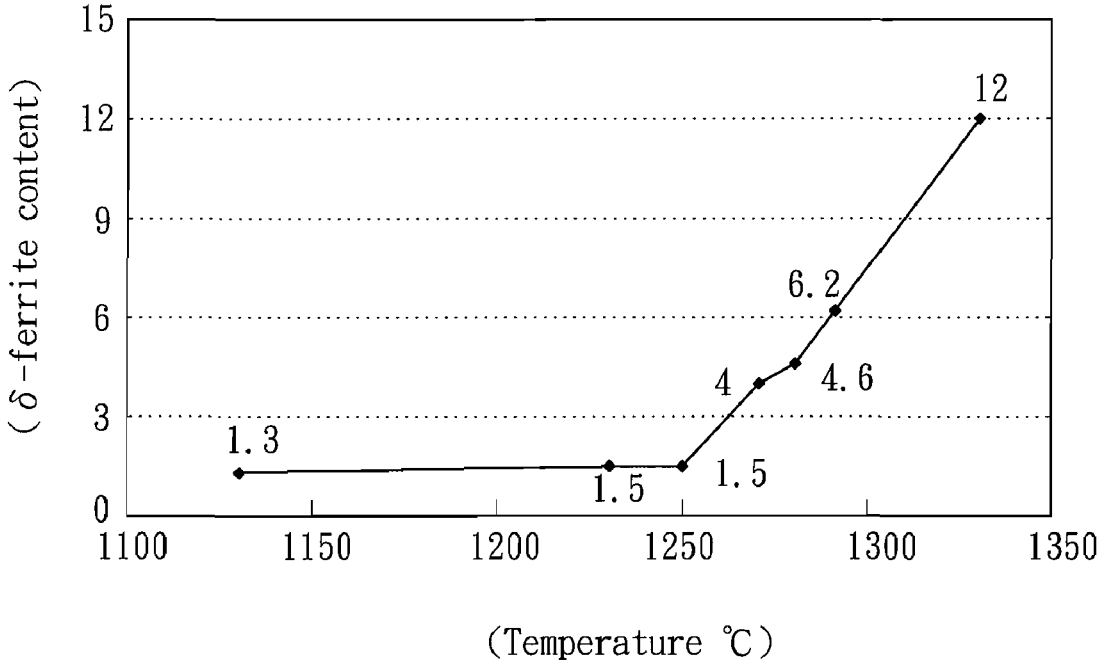
FIG. 1 is a diagram illustrating the relationship between δ-ferrite content of the preferred embodiment of the austenitic stainless steel of this invention and hot working temperature.

The preferred embodiment of the low nickel containing chromium-nickel-manganese-copper austenitic stainless steel of the present invention comprises: (a) 0.03 wt % to 0.12 wt % of C; (b) 0.2 wt % to 1.0 wt % of Si; (c) 8.55 wt % to 10.12 wt % of Mn; (d) 14.0 wt % to 16.0 wt % of Cr; (e) 4.05 wt % to 4.31 wt % of Ni; (f) 0.04 wt % to 0.07 wt % of N; (g) 1.0 wt % to 3.5 wt % of Cu; (h) trace amount of Mo; and the balance being Fe and incidental impurities. The austenitic stainless steel has a δ-ferrite content that is less than 8.5 and that satisfies the following formula $$\delta\text{-ferrite}=6.77[(d)+(h)+1.5(b)]-4.85[(e)+30(a)+30(f)+0.5(c)+0.3(g)]-52.75,$$

wherein (a), (b), (c), (d), (e), (f), (g), (h) in the formula mean the content of the respective elements (wt %).

The austenitic stainless steel can further comprise 5 to 30 ppm of B so as to improve hot workability. The contents of harmful impurities, such as S (sulfur) and P (phosphorous), are as small as possible. However, due to cost concerns associated with removal of these impurities, the S content is limited to 150 ppm, and the P content is limited to 0.06 wt %.

FIG. 1 illustrates the relationship between the δ-ferrite content of the preferred embodiment of the austenitic stainless steel of this invention and temperature. The results show that when temperature is raised to above 1250° C. during hot rolling, the δ-ferrite content rises sharply, which results in the risk of edge cracking of a rolled plate of the austenitic stainless steel. In addition, a minimum temperature of 1050° C. during hot rolling is required so as to obtain the requisite mechanical strength.

Examples and Comparative Examples

The following Examples and Comparative Examples illustrate the unexpectedly better results of this invention over the prior art.

Table 1 illustrates an edge crack effect test for different test specimens of the austenitic stainless steel of Examples 1 to 11 and comparative Examples 1 to 5, which differ in composition (only elements Ni, C, Si, Mn, Cr, Cu, and N are shown). The test was conducted by hot rolling at a temperature ranging from 1050° C. to 1250° C. The test results show that each Example of the austenitic stainless steel of this invention has a δ-ferrite content less than 8.5, and that no edge cracking was observed for the test specimens of Examples 1 to 11. Each of the test specimens of the Comparative Examples 1 to 5 has a δ-ferrite content greater than 8.5. Edge cracks were found in each of the test specimens of the Comparative Examples 1 to 5. The results shown in Table 1 demonstrate that edge cracks can be avoided when the Ni content ranges from 4.05% to 4.55% with the Nitrogen content ranging from 0.04% to 0.061%.

TABLE 1

| | Ni | C | Si | Mn | Cr | Cu | N | δ-ferrite | Edge crack |
|---|---|---|---|---|---|---|---|---|---|
| Examples | | | | | | | | | |
| 1 | 4.31 | 0.053 | 0.50 | 7.60 | 16.30 | 1.60 | 0.041 | 8.49 | None |
| 2 | 4.05 | 0.032 | 0.53 | 7.85 | 15.36 | 1.71 | 0.04 | 6.636 | None |
| 3 | 4.07 | 0.032 | 0.54 | 8.00 | 15.33 | 1.66 | 0.043 | 6.259 | Noen |
| 4 | 4.55 | 0.032 | 0.58 | 7.54 | 15.23 | 1.59 | 0.041 | 4.984 | None |
| 5 | 4.15 | 0.059 | 0.62 | 7.44 | 15.26 | 1.65 | 0.042 | 3.859 | None |
| 6 | 4.24 | 0.046 | 0.42 | 7.86 | 15.68 | 1.66 | 0.061 | 3.278 | None |
| 7 | 4.21 | 0.051 | 0.49 | 7.63 | 15.16 | 1.62 | 0.041 | 1.684 | None |
| 8 | 4.09 | 0.060 | 0.50 | 8.08 | 15.14 | 1.70 | 0.042 | 0.109 | None |
| 9 | 4.19 | 0.066 | 0.54 | 7.76 | 14.99 | 1.65 | 0.044 | −1.989 | None |
| 10 | 4.15 | 0.055 | 0.36 | 8.55 | 14.6 | 1.67 | 0.053 | −8.66 | None |
| 11 | 4.18 | 0.051 | 0.36 | 10.12 | 14.69 | 1.63 | 0.056 | −11.69 | None |
| Comparative Examples | | | | | | | | | |
| 1 | 4.31 | 0.039 | 0.47 | 7.07 | 19.04 | 2.15 | 0.039 | 28.58 | Cracking |
| 2 | 4.36 | 0.05 | 0.45 | 7.58 | 17.53 | 2.03 | 0.039 | 15.82 | Cracking |
| 3 | 4.37 | 0.046 | 0.47 | 7.96 | 18.33 | 1.71 | 0.035 | 22.60 | Cracking |
| 4 | 4.77 | 0.052 | 0.51 | 7.54 | 18.13 | 1.73 | 0.032 | 19.85 | Cracking |
| 5 | 4.45 | 0.051 | 0.53 | 7.5 | 16.20 | 1.5 | 0.031 | 9.1 | cracking |

Table 2 illustrates a corrosion resistance test (ASTM B117) using salt fog for different test specimens of the austenitic stainless steel of Examples 10 to 14 and comparative Example 6 (type 304 stainless steel), which differ in composition (only elements Ni, C, Si, Mn, Cr, Cu, and B are shown). The test results show that each Example of the austenitic stainless steel of this invention has a corrosion rate that is as low as that of the type 304 stainless steel (no more than 0.1%) of the prior art.

TABLE 2

| | Ni | C | Si | Mn | Cr | Cu | B | Corrosionrate |
|---|---|---|---|---|---|---|---|---|
| Examples | | | | | | | | |
| 10 | 4.15 | 0.055 | 0.36 | 8.55 | 14.6 | 1.67 | 0.0034 | ≦0.1 wt % |
| 11 | 4.18 | 0.051 | 0.36 | 10.12 | 14.69 | 1.63 | 0.0036 | ≦0.1 wt % |
| 12 | 4.40 | 0.058 | 0.48 | 7.56 | 15.26 | 1.79 | 0.0001 | ≦0.1 wt % |
| 13 | 4.11 | 0.051 | 0.54 | 7.86 | 15.35 | 1.69 | 0.0032 | ≦0.1 wt % |
| 14 | 3.40 | 0.059 | 0.77 | 7.84 | 14.94 | 1.78 | 0.0001 | ≦0.1 wt % |
| Comparative Example | | | | | | | | |
| 6 | 8.02 | 0.045 | 0.53 | 1.25 | 18.19 | 0.23 | 0.0008 | ≦0.1 wt % |

It is noted that the chromium content in each of the Examples 1 to 14 of the austenitic stainless steel of this invention is less than 17 wt %, which is a minimum requirement of the prior art for providing minimum levels of corrosion resistance.

Table 3 illustrates compositions of test specimens of the austenitic stainless steel of Examples 15 to 24 and comparative Examples 7 to 10 (only elements Ni, C, Si, Mn, Cr, and Cu are shown). Table 4 illustrates a mechanical strength test for the test specimens of the austenitic stainless steel of the Examples 10, 11, and 15 to 24 and the comparative Examples 7 to 10. The test results show that the austenitic stainless steel of this invention has an elongation better than those of type 304 stainless steel of the prior art. Other mechanical properties, such as tensile strength, yield strength, and hardness, of the austenitic stainless steel of this invention are comparable to those of type 304 stainless steel of the prior art.

TABLE 3

| | Ni | C | Si | Mn | Cr | Cu |
|---|---|---|---|---|---|---|
| Examples | | | | | | |
| 15 | 4.26 | 0.036 | 0.56 | 7.7 | 15.12 | 1.67 |
| 16 | 4.21 | 0.039 | 0.47 | 7.97 | 15.32 | 1.66 |

TABLE 3-continued

| | Ni | C | Si | Mn | Cr | Cu |
|---|---|---|---|---|---|---|
| 17 | 4.21 | 0.056 | 0.54 | 7.69 | 15.26 | 1.79 |
| 18 | 4.15 | 0.049 | 0.48 | 7.7 | 15.26 | 1.66 |
| 19 | 4.20 | 0.040 | 0.49 | 7.93 | 15.35 | 1.67 |
| 20 | 4.21 | 0.039 | 0.48 | 7.96 | 15.29 | 1.66 |
| 21 | 4.22 | 0.044 | 0.46 | 7.93 | 15.01 | 1.70 |
| 22 | 4.17 | 0.064 | 0.5 | 7.71 | 15.16 | 1.65 |
| 23 | 4.20 | 0.055 | 0.52 | 7.70 | 15.32 | 1.68 |
| 24 | 4.41 | 0.058 | 0.48 | 7.56 | 15.27 | 1.80 |

TABLE 3-continued

| | Ni | C | Si | Mn | Cr | Cu |
|---|---|---|---|---|---|---|
| Comparative Example | | | | | | |
| 7 | 8.06 | 0.039 | 0.53 | 1.17 | 18.14 | 0.23 |
| 8 | 8.04 | 0.041 | 0.50 | 1.15 | 18.15 | 0.21 |
| 9 | 8.08 | 0.039 | 0.49 | 1.18 | 18.17 | 0.24 |
| 10 | 8.03 | 0.040 | 0.52 | 1.11 | 18.09 | 0.22 |

TABLE 4

| | Tensile strength, (MPa) | Yield strength, (MPa) | Hardness, (HRBO) | Elongation, (%) |
|---|---|---|---|---|
| Examples | | | | |
| 10 | 603.5 | 270.8 | 81.6 | 49.9 |
| 11 | 642.1 | 335.0 | 82.3 | 43.5 |
| 15 | 621.7 | 313.3 | 83.5 | 55.2 |
| 16 | 630.2 | 289.5 | 82.5 | 55.3 |
| 17 | 628.5 | 287.6 | 82.3 | 55.0 |
| 18 | 642.3 | 291.3 | 82.8 | 53.1 |
| 19 | 618.4 | 312.0 | 84.3 | 53.7 |
| 20 | 634.6 | 296.4 | 82.8 | 53.8 |
| 21 | 639.0 | 317.2 | 83.9 | 54.1 |
| 22 | 642.6 | 319.7 | 84.7 | 54.3 |
| 23 | 621.7 | 313.3 | 83.5 | 55.2 |
| 24 | 641.9 | 301.6 | 83.4 | 53.4 |
| Comparative Examples | | | | |
| 7 | 660.0 | 324.6 | 83.2 | 49.1 |
| 8 | 660.6 | 325.0 | 82.6 | 46.8 |
| 9 | 663.8 | 328.9 | 82.4 | 48.8 |
| 10 | 657.8 | 322.8 | 81.8 | 48.5 |

The aforesaid tests show that the austenitic stainless steel of this invention is capable of exhibiting excellent mechanical strength, corrosion resistance, and phase stability during hot or cold working with a relatively low nickel content and a low chromium content as compared to those of the prior art.

Those skilled in the art will recognize that the materials and methods of the present invention will have various other uses in addition to the above described embodiments. They will appreciate that the foregoing specification and accompanying drawings are set forth by way of illustration and not limitation of the invention. It will further be appreciated that various modifications and changes may be made therein without departing from the spirit and scope of the present invention, which is to be limited solely by the scope of the appended claims.

We claim:

1. An austenitic stainless steel comprising:

(a) 0.051 wt % to 0.055 wt % of C;

(b) 0.2 wt % to 1.0 wt % of Si;

(c) 8.55 wt % to 10.12 wt % of Mn;

(d) 14.6 wt % to 14.69 wt % of Cr;

(e) 4.15 wt % to 4.18 wt % of Ni;

(f) 0.04 wt % to 0.07 wt % of N;

(g) 1.63 wt % to 1.67 wt % of Cu;

(h) trace amount of Mo; and the balance being Fe and incidental impurities;

and optionally one or more of the following residuals 5 to 30 ppm of B, no more than 150 ppm of S, and/or no more than 0.06 wt % of P, wherein said austenitic stainless steel has a δ-ferrite content that is less than 8.5 and that satisfies the following formula $$\delta\text{-ferrite}=6.77[(d)+(h)+1.5(b)]-4.85[(e)+30(a)+30(f)+0.5(c)+0.3(g)]-52.75.$$

2. An austenitic stainless steel comprising:

(a) 0.055 wt % of C;

(b) 0.36 wt % of Si;

(c) 8.55 wt % of Mn;

(d) 14.6 wt % of Cr;

(e) 4.15 wt % of Ni;

(f) 0.04 wt % to 0.07 wt % of N;

(g) 1.67 wt % of Cu;

(h) trace amount of Mo; and the balance being Fe and incidental impurities; and optionally one or more of the following residuals 5 to 30 ppm of B, no more than 150 ppm of S, and/or no more than 0.06 wt % of P, wherein said austenitic stainless steel has a δ-ferrite content that is less than 8.5 and that satisfies the following formula $$\delta\text{-ferrite}=6.77[(d)+(h)+1.5(b)]-4.85[(e)+30(a)+30(a)+0.5(c)+0.3(g)]-52.75.$$

3. An austenitic stainless steel comprising:

(a) 0.051 wt % of C;

(b) 0.36 wt % of Si;

(c) 10.12 wt % of Mn;

(d) 14.69 wt % of Cr;

(e) 4.18 wt % of Ni;

(f) 0.04 wt % to 0.07 wt % of N;

(g) 1.63 wt % of Cu;

(h) trace amount of Mo; and the balance being Fe and incidental impurities; and optionally one or more of the following residuals 5 to 30 ppm of B, no more than 150 ppm of S, and/or no more than 0.06 wt % of P, wherein said austenitic stainless steel has a δ-ferrite content that is less than 8.5 and that satisfies the following formula $$\delta\text{-ferrite}=6.77[(d)+(h)+1.5(b)]-4.85[(e)+30(a)+30(f)+0.5(c)+0.3(g)]-52.75.$$

* * * * *